US012716208B2

(12) United States Patent
Shibata et al.

(10) Patent No.: US 12,716,208 B2
(45) Date of Patent: Aug. 25, 2026

(54) WORKING MACHINE AND MANAGEMENT SYSTEM FOR WORKING MACHINE

(71) Applicant: SUMITOMO CONSTRUCTION MACHINERY CO., LTD., Tokyo (JP)

(72) Inventors: Jun Shibata, Chiba (JP); Takashi Nishi, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 8 days.

(21) Appl. No.: 18/976,953

(22) Filed: Dec. 11, 2024

(65) Prior Publication Data

US 2025/0198130 A1 Jun. 19, 2025

(30) Foreign Application Priority Data

Dec. 19, 2023 (JP) ..... 2023-213675

(51) Int. Cl.

| | |
|---|---|
| ***E02F 9/26*** | (2006.01) |
| ***E02F 3/42*** | (2006.01) |
| ***E02F 3/43*** | (2006.01) |

(52) U.S. Cl.

CPC ..... *E02F 9/264* (2013.01); *E02F 3/431* (2013.01); *E02F 3/422* (2013.01)

(58) Field of Classification Search

None

See application file for complete search history.

(56) References Cited

U.S. PATENT DOCUMENTS

| | | | | |
|---|---|---|---|---|
| 2020/0340208 | A1* | 10/2020 | Kitajima | B66C 23/86 |
| 2022/0056663 | A1* | 2/2022 | Meguriya | G06Q 10/10 |
| 2022/0127817 | A1* | 4/2022 | Sano | E02F 9/265 |
| 2022/0154424 | A1* | 5/2022 | Indoh | E02F 9/267 |
| 2023/0167625 | A1* | 6/2023 | Hama | E02F 9/265 701/2 |
| 2023/0384146 | A1* | 11/2023 | Ji | G01G 19/083 |

FOREIGN PATENT DOCUMENTS

| | | | | |
|---|---|---|---|---|
| JP | 2021156801 A | * | 10/2021 | |
| JP | 2021-195839 | | 12/2021 | |
| WO | WO-2020204007 A1 | * | 10/2020 | G06N 3/045 |

OTHER PUBLICATIONS

Machine translation of JP-2021156801-A (Year: 2025).*

* cited by examiner

*Primary Examiner* — Jennifer M Anda

(74) *Attorney, Agent, or Firm* — IPUSA, PLLC

(57) ABSTRACT

A working machine includes a physical quantity detector, a circuitry configured to calibrate the physical quantity detector, and a transceiver configured to transmit a calibration result of the physical quantity detector to a management server that is located outside the working machine.

8 Claims, 8 Drawing Sheets

WORKING MACHINE AND MANAGEMENT SYSTEM FOR WORKING MACHINE

The present application is based on and claims priority to Japanese patent application No. 2023-213675 filed on Dec. 19, 2023, with the Japanese Patent Office, the entire contents of which are hereby incorporated by reference.

BACKGROUND

Technical Field

This disclosure relates to working machines and management systems for working machines.

Description of Related Art

In the related art, construction machines including a controller capable of performing calibration of control parameters are known. The shovel described in the related art corrects control parameters by calibration and compensates for changes in control characteristics due to aging of hydraulic components, moving components, sensors, etc.

In a hydraulic excavator described in the related art, the controller is shifted to a calibration operation mode every time an operator gives a calibration instruction to the controller, the hydraulic excavator is operated for a predetermined time, or a predetermined duration has elapsed.

SUMMARY

A working machine includes a physical quantity detector, a circuitry configured to calibrate the physical quantity detector, and a transceiver configured to transmit a calibration result of the physical quantity detector to a management server that is located outside the working machine.

DETAILED DESCRIPTION

With regard to the hydraulic excavator described in the related art, it is difficult for a business operator who manufactures, repairs, and maintains the hydraulic excavator to know whether a user of the hydraulic excavator appropriately performs necessary calibration.

Therefore, when a failure occurs in the user's working machine, for example, the business operator may be unable to determine whether the failure is caused by a failure of the working machine or is caused by a failure to properly perform necessary calibration, and it may require time to respond.

The present disclosure provides a working machine and its management system that can confirm that necessary calibration is properly performed.

Another embodiment of the present disclosure provides a working machine management system including the working and the management server, wherein the management server includes a communication server configured to receive the calibration result transmitted via the transceiver of the working machine, and a storage configured to store the calibration result received via the communication server.

According to the above embodiments of the present disclosure, it is possible to provide a working machine and a management system for the working machine that can confirm that necessary calibration is properly performed.

In the following, embodiments of the present invention will be described with reference to the accompanying drawings.

Figure 1:
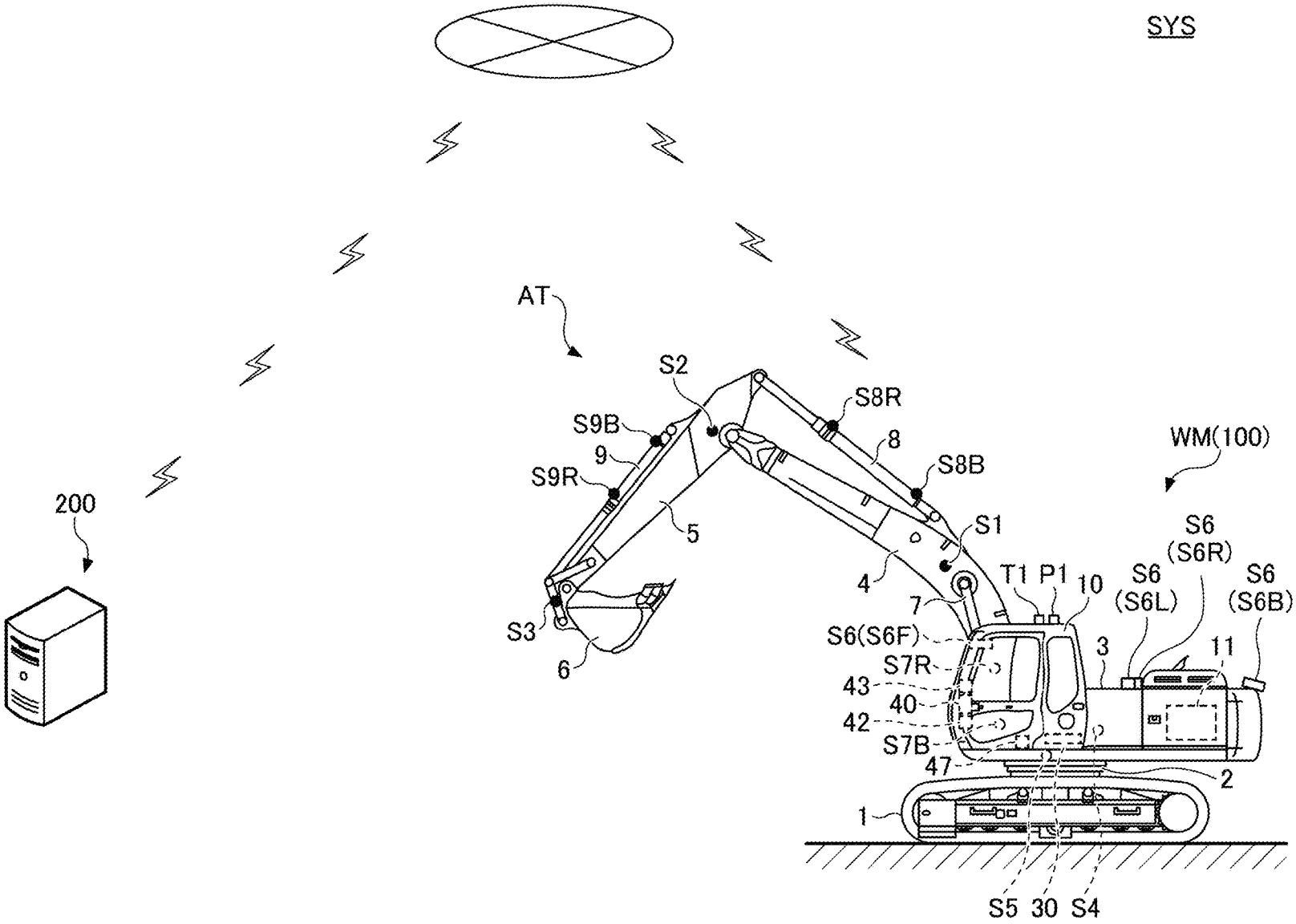
FIG. 1 is a schematic diagram illustrating an embodiment of a management system for a working machine according to the present disclosure.

FIG. 1 is a schematic diagram illustrating the embodiment of the management system for the working machine according to the present disclosure. The management system SYS of the working machine according to the present embodiment includes, for example, one or more working machines WM and one or more management devices 200 for managing the one or more working machines WM.

The working machine WM included in the management system SYS of the working machine is, for example, a shovel 100. In addition to the shovel 100, the management system SYS of the working machine may include a working machine WM such as an asphalt finisher, a wheel loader, a crane, or a forklift.

The management device 200 included in the management system SYS of the working machine of the present embodiment is, for example, a network server connected to a network. The management device 200 may be, for example, an information terminal owned by the business operator who manufactures, repairs, or maintains the working machine WM or the user of the working machine WM. The management device 200 is configured to be able to communicate with the working machine WM such as the shovel 100, for example, via the network.

Figure 2:
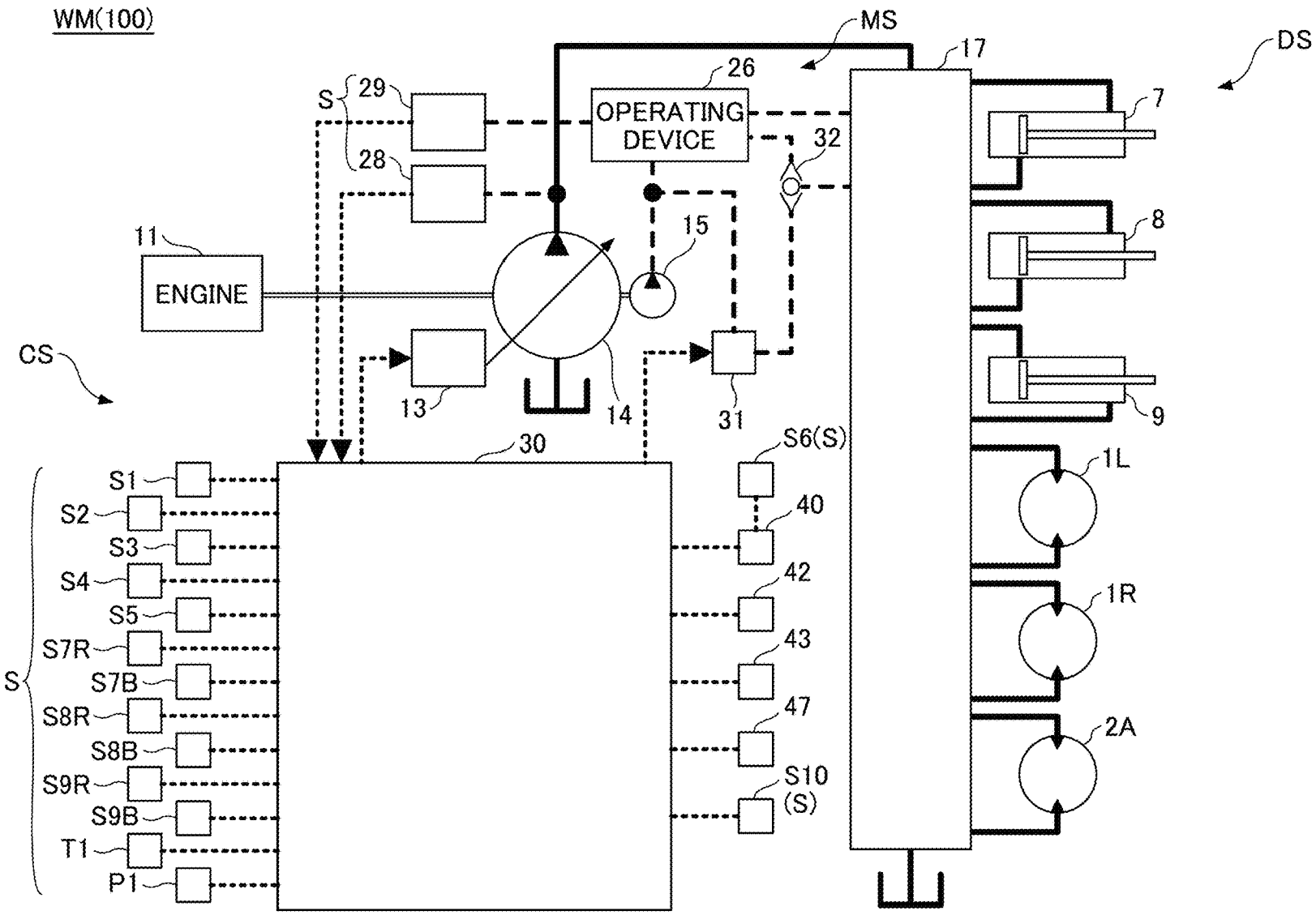
FIG. 2 is a schematic diagram illustrating a configuration example of the working machine in the management system of FIG. 1.
Figure 3:
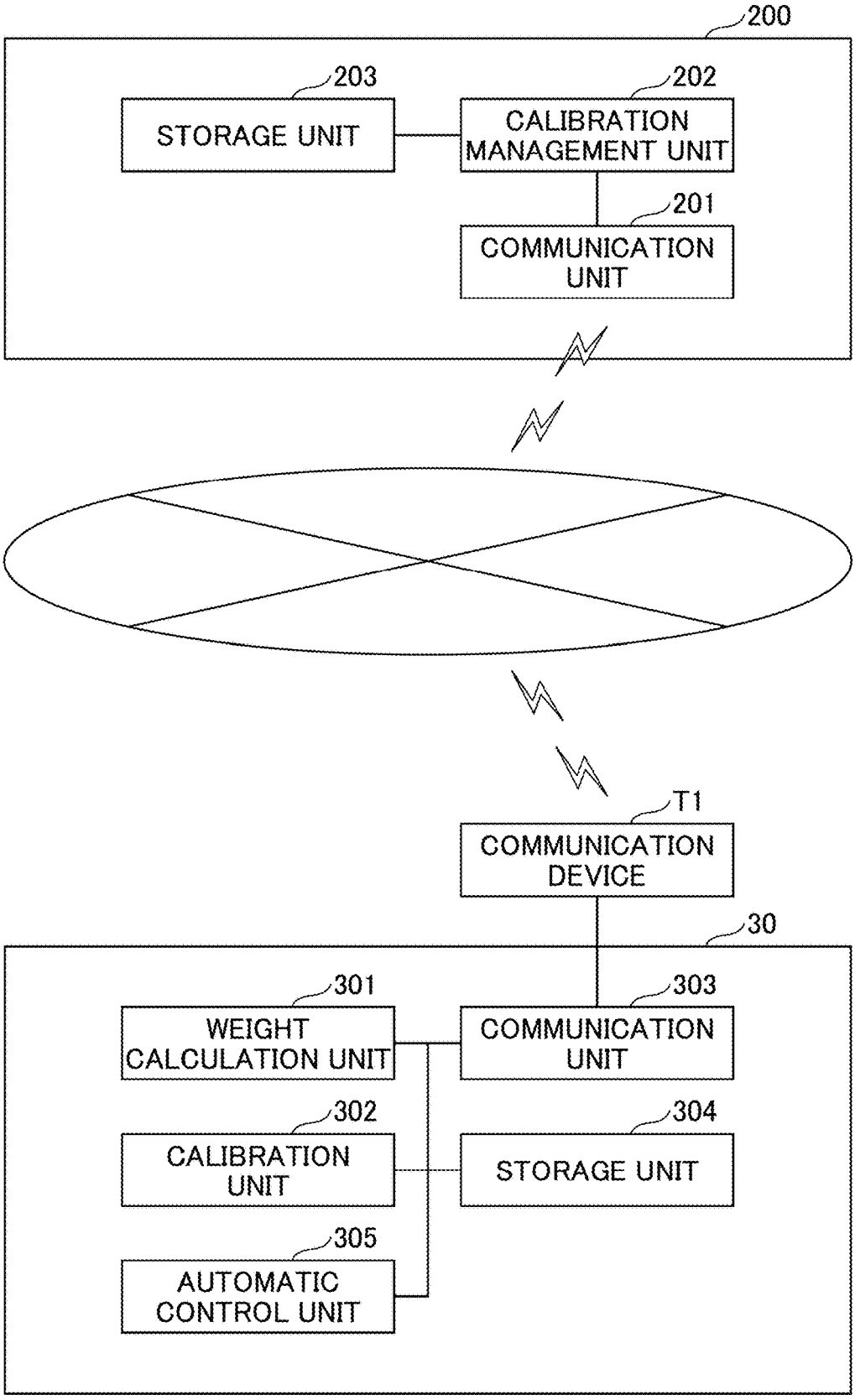
FIG. 3 is a block diagram of the controller and a management device of the working machine of FIG. 1.

FIG. 2 is a schematic diagram illustrating a configuration example of the shovel 100 which is an example of the working machine WM in the management system SYS of FIG. 1. FIG. 3 is a functional block diagram of the controller 30 of the shovel 100, and the management device 200 included in the management system SYS of the working machine of FIG. 1. In FIG. 2, a transmission of mechanical power, a hydraulic fluid line, a pilot line, and a transmission of electric signals are indicated by double lines, solid lines, dashed lines, and dotted lines, respectively.

Although details will be described later, the working machine WM of the present embodiment is characterized in that, as shown in FIG. 2, it includes the physical quantity detection device S, the controller 30 for calibrating the physical quantity detection device S, and the communication device T1 for transmitting the calibration result of the physical quantity detection device S to the external management device 200.

Similarly, although details will be described later, the management system SYS of the working machine according to the present embodiment is characterized in that it includes the above-described working machine WM and the management device 200 having the following configuration. As shown in FIG. 3, the management device 200 includes a communication unit 201 which receives the calibration result of the physical quantity detection device S transmitted via the communication device T1 of the working machine WM, and a storage unit 203 which stores the calibration result of the physical quantity detection device S received via the communication unit 201.

An example of the configuration of the working machine WM and the management device 200 included in the management system SYS of the working machine according to the present embodiment will be described in detail below.

As shown in FIG. 1, the shovel 100 as an example of the working machine WM of the present embodiment includes, for example, a lower traveling body 1 capable of traveling, an upper swivel body 3 mounted on the lower traveling body 1 capable of swiveling via a swivel mechanism 2, and a work attachment AT attached to the upper swivel body 3.

The work attachment AT includes, for example, a boom 4 mounted on the upper swivel body 3 capable of lifting, an arm 5 rotatably attached to the tip of the boom 4, and a bucket 6 rotatably attached to the tip of the arm 5.

As shown in FIG. 2, the shovel 100 as an example of the working machine WM of the present embodiment includes, for example, a drive device DS for driving the shovel 100, a control system CS for controlling the drive device DS, and an operating system MS for operating the shovel 100.

The drive device DS includes, for example, an engine 11, a regulator 13, a main pump 14, and a control valve 17. The drive device DS includes, for example, hydraulic actuators such as the left and right traveling hydraulic motors 1L and 1R, the swivel hydraulic motor 2A, a boom cylinder 7, an arm cylinder 8, and a bucket cylinder 9.

The engine 11 is a power source of the drive device DS and is mounted, for example, at the rear of the upper swivel body 3. The engine 11 is directly or indirectly controlled, for example, by the controller 30, and rotates at a predetermined target speed to drive the main pump 14 and the pilot pump 15. The engine 11 is, for example, a diesel engine using diesel oil as fuel.

The regulator 13 controls, for example, the discharge amount of the main pump 14 by adjusting the angle (tilt angle) of the swash plate of the main pump 14 in accordance with a control command from the controller 30.

The main pump 14 is, for example, mounted at the rear of the upper swivel body 3 in the same manner as the engine 11, and is driven by the engine 11 to supply hydraulic fluid to the control valve 17 through a high-pressure hydraulic line. The main pump 14 is, for example, a variable displacement hydraulic pump. The main pump 14 controls the discharge flow rate (discharge pressure) by adjusting the stroke length of the piston by adjusting, for example, the tilt angle of the swash plate by the regulator 13.

The control valve 17 is, for example, mounted at the center of the upper swivel body 3 and is configured by a control valve for controlling the flow rate and direction of hydraulic fluid supplied to each hydraulic actuator of the drive device DS. The control valve 17 controls, for example, the flow rate and direction of hydraulic fluid supplied from the main pump 14 to each hydraulic actuator according to the pilot pressure supplied from the operating device 26 of the operating system MS described later.

The left and right traveling hydraulic motors 1L and 1R, which are hydraulic actuators, are, for example, mounted on the lower traveling body 1. The traveling hydraulic motors 1L and 1R drive the left and right crawlers included in the lower traveling body 1 to move and rotate the shovel 100.

The swivel hydraulic motor 2A, which is a hydraulic actuator, is included in, for example, a swivel mechanism 2 for swiveling the upper swivel body 3. The swivel mechanism 2 includes, for example, a swivel gear and a swivel bearing mounted on the lower traveling body 1, and a swivel hydraulic motor 2A and a speed reducer mounted on the upper swivel body 3. The swivel mechanism 2 rotates the swivel hydraulic motor 2A, for example, so that the pinion of the speed reducer engaged with the swivel gear rotates, and the upper swivel body 3 swivels with respect to the lower traveling body 1. Instead of the swivel hydraulic motor 2A, the swivel mechanism may include an electric motor.

The boom cylinder 7, the arm cylinder 8, and the bucket cylinder 9, which are hydraulic actuators included in the drive device DS, are hydraulic cylinders mounted on the boom 4, the arm 5, and the bucket 6, for example, as shown in FIG. 1. That is, the drive device DS includes, for example, a plurality of hydraulic cylinders, and drives the work attachment AT including the boom 4, the arm 5, and the bucket 6.

Specifically, in the boom cylinder 7, for example, the tip of the piston rod is freely rotatably connected to the middle of the boom 4, and the base end of the cylinder opposite to the tip of the piston rod is freely rotatably connected to the upper swivel body 3. By extending and contracting the piston rod of the boom cylinder 7, the boom 4 is rotated around a boom foot pin parallel to the width direction of the upper swivel body 3 and lifts.

In the arm cylinder 8, for example, the tip of the piston rod is freely rotatably connected to a base end opposite to the tip of the arm 5, and the base end of the cylinder opposite to the tip of the piston rod is freely rotatably connected to an intermediate part of the boom 4. By extending and contracting the piston rod of the arm cylinder 8, the arm 5 is rotated around an arm pin parallel to the width direction of the upper swivel body 3.

In the bucket cylinder 9, for example, the tip of the piston rod is freely rotatably connected to a link mechanism at the tip of the arm 5, and the base end of the cylinder opposite to the tip of the piston rod is freely rotatably connected to a base end opposite to the tip of the arm 5. A link mechanism provided at the tip of the arm 5 is connected to a base end opposite to the tip of the bucket 6 having a tooth. By extending and contracting the piston rod of the arm cylinder 8 connected to the link mechanism, the bucket 6 connected to the link mechanism is rotated around a bucket pin parallel to the width direction of the upper swivel body 3.

The control system CS for controlling the drive device DS includes, for example, a controller 30 and a plurality of physical quantity detection devices S, as shown in FIG. 2. The control system CS includes, for example, a proportional valve 31, a display device 40, an input device 42, an audio output device 43, a storage device 47, a positioning device P1, and a communication device T1.

As shown in FIG. 1, for example, the controller 30 is installed in a cabin 10 provided on the front left of the upper swivel body 3. The controller 30 includes, for example, a processing device such as a central processing unit (CPU), storage devices such as RAM and ROM, a timer, and one or more microcontrollers provided with input/output units. The controller 30 realizes various functions including calibration of the physical quantity detection device S by executing, for example, a program stored in the storage device by the processing device.

The physical quantity detection device S includes, for example, a boom angle sensor S1, an arm angle sensor S2, a bucket angle sensor S3, a body tilt sensor S4, a swivel state sensor S5, and an imaging device S6. The physical quantity detection device S includes, for example, a boom rod pressure sensor S7R, a boom bottom pressure sensor S7B, an arm rod pressure sensor S8R, an arm bottom pressure sensor S8B, a bucket rod pressure sensor S9R, a bucket bottom pressure sensor S9B, and a temperature sensor S10. The physical quantity detection device S includes, for example, a discharge pressure sensor 28 and an operating pressure sensor 29.

The boom angle sensor S1, the arm angle sensor S2, and the bucket angle sensor S3 are attached to the boom 4, the arm 5, and the bucket 6, respectively. The boom angle sensor S1 detects, for example, the angle of the boom 4 relative to the upper swivel body 3. The arm angle sensor S2 detects the angle of the arm 5 relative to the boom 4. The bucket angle sensor S3 detects the angle of the bucket 6 relative to the arm 5.

The boom angle sensor S1, the arm angle sensor S2, and the bucket angle sensor S3 output each detection result to the controller 30. These angle sensors may be composed of, for example, a rotary encoder, an acceleration sensor, an inertia sensor (IMU), a potentiometer, or a stroke sensor.

The body tilt sensor S4 detects, for example, the tilt angle (roll angle and pitch angle) of the lower traveling body 1 or the upper swivel body 3 relative to the horizontal plane, and outputs the detection result to the controller 30. The body tilt sensor S4 may be composed of, for example, a tilt sensor, an inertia sensor, or an acceleration sensor.

The swivel state sensor S5 detects, for example, the swivel angular velocity and the swivel angle of the upper swivel body 3, and outputs the detection result to the controller 30. The swivel state sensor S5 may be composed of, for example, a gyro sensor, a resolver, an inertia sensor, or a rotary encoder.

The imaging device S6 functions as an object detection device that detects, for example, the distance, direction, size, shape, and the like to an object around the shovel 100, and outputs the detection result to the controller 30. The imaging device S6 may be composed of, for example, a monocular camera, a stereo camera, or a laser radar (LiDAR).

In the example shown in FIG. 1, the imaging device S6 includes, for example, a camera S6F for capturing images of the front direction of the shovel 100, a camera S6L for capturing images of the left direction of the shovel 100, a camera S6R for capturing images of the right direction of the shovel 100, and a camera S6B for capturing images of the rear direction of the shovel 100.

The boom rod pressure sensor S7R and the boom bottom pressure sensor S7B detect the pressure of the rod hydraulic chamber and the bottom hydraulic chamber of the boom cylinder 7, respectively. Similarly, the arm rod pressure sensor S8R and the arm bottom pressure sensor S8B detect pressures in the rod hydraulic chamber and bottom hydraulic chamber of the arm cylinder 8, respectively. The bucket rod pressure sensor S9R and the bucket bottom pressure sensor S9B detect pressures in the rod hydraulic chamber and bottom hydraulic chamber of the bucket cylinder 9, respectively.

These sensors from the boom rod pressure sensor S7R to the bucket bottom pressure sensor S9B can be configured by, for example, hydraulic sensors provided in each hydraulic cylinder from the boom cylinder 7 to the bucket cylinder 9. These sensors from the boom rod pressure sensor S7R to the bucket bottom pressure sensor S9B output detection results to the controller 30.

The physical quantity detection device S includes, for example, a weight detection device that detects the weight of a load loaded on the work attachment AT. The weight detection device includes, for example, an attitude detection device that detects the attitude of the work attachment AT and a pressure detection device that detects the pressure of hydraulic fluid in at least one of the hydraulic cylinders from the boom cylinder 7 to the bucket cylinder 9.

More specifically, attitude detection devices included in the weight detection device include, for example, a boom angle sensor S1, an arm angle sensor S2, a bucket angle sensor S3, a body tilt sensor S4, and a swivel state sensor S5. The pressure detection device included in the weight detection device includes, for example, a boom rod pressure sensor S7R and a boom bottom pressure sensor S7B. The pressure detection device may include an arm rod pressure sensor S8R, an arm bottom pressure sensor S8B, a bucket rod pressure sensor S9R, and a bucket bottom pressure sensor S9B. The weight detection device including the attitude detection device and the pressure detection device outputs the detection result to, for example, a weight calculation unit 301 (see FIG. 3) described later. The weight calculation unit 301 calculates the weight of the load loaded on the work attachment AT based on the detection result.

The temperature sensor S10 is provided in a hydraulic fluid tank for storing hydraulic fluid supplied to each device including the main pump 14 of the drive device DS, for example. The temperature sensor S10 may be provided in a hydraulic fluid path connecting the main pump 14 and each hydraulic actuator, for example. The temperature sensor S10 outputs the detected temperature of the hydraulic fluid to the controller 30.

The discharge pressure sensor 28 detects the pressure of the hydraulic fluid discharged from the main pump 14, for example, and outputs the detection result to the controller 30. The operating pressure sensor 29 detects, for example, the pilot valve outlet pressure acting on the control valve 17 in response to the operation of the operating device 26 by the operator, and outputs the detection result to the controller 30. The discharge pressure sensor 28 and the operating pressure sensor 29 are composed of, for example, a hydraulic pressure sensor.

The proportional valve 31 is provided on the pilot line connecting the pilot pump 15 and the shuttle valve 32, and is configured so that the flow path area can be changed. The proportional valve 31 operates in response to a control command input from the controller 30. Thus, the controller 30 can supply the hydraulic fluid discharged from the pilot pump 15 to the pilot port of the corresponding control valve in the control valve 17 via the proportional valve 31 and the shuttle valve 32 even when the operator is not operating the operating device 26.

The display device 40 is provided in the cabin 10 at a place easily visible to a seated operator, and displays various information images controlled by the controller 30. The display device 40 may be connected to the controller 30 via an in-vehicle communication network such as CAN (Controller Area Network) or may be connected to the controller 30 via a one-to-one dedicated line.

The input device 42 is provided in the cabin 10 within reach of a seated operator, receives various operation inputs by the operator, and outputs signals corresponding to the operation inputs to the controller 30. The input device 42 includes a touch panel mounted on the display of the display device for displaying various information images, a knob switch provided at the tip of the operation lever of the operating device 26, and a button switch, lever, toggle, rotary dial, etc. provided around the display device 40. Signals corresponding to the operations performed on the input device 42 are received by the controller 30.

The audio output device 43 is provided in the cabin 10, for example, and is connected to the controller 30 to output audio under the control of the controller 30. The audio output device 43 is, for example, a speaker or a buzzer. The audio output device 43 outputs various kinds of information in response to the audio output command from the controller 30.

The storage device 47 is provided in the cabin 10, for example, and stores various kinds of information under the control of the controller 30. The storage device 47 is, for example, a nonvolatile storage medium such as a semiconductor memory. The storage device 47 may store information output by various devices during the operation of the shovel 100, or may store information acquired via various devices before the operation of the shovel 100 starts. The storage device 47 may store data related to the target construction surface acquired via the communication device T1 or the like or set via the input device 42 or the like. The target construction surface may be set (stored) by the operator of the shovel 100 or set by the construction manager or the like.

The positioning device P1 detects, for example, the position and direction of the upper swivel body 3 and outputs the detection result to the controller 30. The positioning device P1 may be configured by, for example, a GNSS (Global Navigation Satellite System) compass. In addition, the function of detecting the direction of the upper swivel body 3 among the functions of the positioning device P1 may be replaced by an azimuth sensor attached to the upper swivel body 3.

The communication device T1 communicates with an external device through a predetermined network including a mobile communication network, a satellite communication network, an Internet network, etc., terminated at a base station. The communication device T1 may be, for example, a mobile communication module corresponding to a mobile communication standard such as LTE (Long Term Evolution), 4G (4th Generation), 5G (5th Generation), or a satellite communication module for connecting to a satellite communication network.

The operating system MS for operating the shovel 100 includes, for example, a pilot pump 15, an operating device 26, and a shuttle valve 32, as shown in FIG. 2.

The pilot pump 15 is mounted, for example, at the rear of the upper swivel body 3 in the same manner as the main pump 14. The pilot pump 15 is, for example, a fixed displacement hydraulic pump. The pilot pump 15 is driven, for example, by the engine 11, and supplies pilot pressure to the operating device 26 via a pilot line.

The operating device 26 includes, for example, a left operating lever, a right operating lever, and a traveling operating device. The traveling operating device includes, for example, a traveling lever and a traveling pedal. In the present embodiment, each of the operating devices 26 is a hydraulic operating device and is connected via a pilot line to the pilot port of a corresponding spool valve in the control valve 17. However, the operating device 26 may be an electric operating device.

The shuttle valve 32 has, for example, two inlet ports and one outlet port, and outputs hydraulic fluid having a higher pilot pressure among the pilot pressures input to the two inlet ports to the outlet port. Of the two inlet ports of the shuttle valve 32, one is connected to the operating device 26, and the other is connected to the proportional valve 31. The outlet port of the shuttle valve 32 is connected to the pilot port of the corresponding control valve in the control valve 17 through the pilot line.

Therefore, the shuttle valve 32 can apply the higher of the pilot pressure generated by the operating device 26 and the pilot pressure generated by the proportional valve 31 to the pilot port of the corresponding control valve. In other words, the controller 30 can control the corresponding control valve and control the operation of various operating elements by making the proportional valve 31 output the pilot pressure higher than the pilot valve outlet pressure output from the operating device 26, regardless of the operation of the operating device 26 by the operator.

The calibration of the physical quantity detection device S mounted on the shovel 100 as an example of the working machine WM will be described below with reference to FIGS. 3 to 8.

For example, as shown in FIG. 3, the controller 30 includes a weight calculation unit 301, a calibration unit 302, a communication unit 303, and a storage unit 304. The controller 30 may also include an automatic control unit 305. Each unit of the controller 30 represents, for example, a function realized by executing a program stored in a storage device such as RAM or ROM included in the controller 30 by a processor such as a CPU included in the controller 30.

The weight calculation unit 301 calculates the weight of a load loaded on the work attachment AT based on the detection result of the physical quantity detection device S input to the controller 30.

More specifically, the physical quantity detection device S includes a weight detection device. The weight detection device includes, for example, as described above, a boom angle sensor S1, an arm angle sensor S2, and a bucket angle sensor S3 as attitude detection devices, and a boom rod pressure sensor S7R and a boom bottom pressure sensor S7B as pressure detection devices.

The weight calculation unit 301 calculates the weight of a load loaded in the bucket 6 of the work attachment AT based on, for example, the detection results of the attitude detector and the pressure detection device, and the weights and sizes of each part of the work attachment AT stored in advance in the storage device of the controller 30.

The calibration unit 302 executes, for example, a process for calibrating the physical quantity detection device S. The process for calibrating the physical quantity detection device S includes, for example, a process for calibrating the weight detection device. The process for calibrating the weight detection device includes, for example, payload calibration, payload test, and zero adjustment.

The payload calibration includes, for example, a process for determining a calculated center of gravity position for calculating the weight of a load loaded on the work attachment AT. A calculated center of gravity refers to a center of gravity of the load calculated based on such as detection results of various detection devices and sizes of each part of the work attachment AT. The payload calibration is performed by, for example, a user of the shovel 100 or a worker of a business that manufactures, repairs, and maintains the shovel 100 when the end attachment of the work attachment AT, such as the bucket 6, is newly registered.

The payload test includes, for example, a process for checking the measurement accuracy by loading a test weight with a known weight on the work attachment AT. In order to maintain the measurement accuracy of the weight detection device, the payload test must be periodically performed, for example, by a user of the shovel 100 or a worker of a business that manufactures, repairs, and maintains the shovel 100.

The zero adjustment includes, for example, a process for offsetting the influence of a material such as mud adhering to the end attachment such as the bucket 6 when detecting the weight of the material loaded on the work attachment AT. The zero adjustment may be performed depending on the condition of the end attachment or periodically. When the zero adjustment is performed periodically, it is desirable to perform it more frequently than the payload test.

The communication unit 303 transmits, for example, the calibration result of the physical quantity detection device S stored in the storage device of the controller 30 or the storage device 47 connected to the controller 30 to the external management device 200 via the communication device T1.

The storage unit 304 stores, for example, the weight of the load of the work attachment AT calculated by the weight calculation unit 301 and the calibration result of the physical quantity detection device S calibrated by the calibration unit 302 in the storage device of the controller 30 or the storage device 47 connected to the controller 30.

The automatic control unit 305 outputs a control command to, for example, the regulator 13, the proportional valve 31, and the like, and supplies hydraulic fluid discharged from the pilot pump 15 to the pilot port of the corresponding control valve in the control valve 17. Thus, the automatic control unit 305 controls the hydraulic actuator included in the drive device DS to automatically control the shovel 100.

The management device 200 includes, for example, a communication unit 201, a calibration management unit 202, and a storage unit 203. Each unit of the management device 200 represents a function realized by, for example, executing a program stored in a storage unit such as RAM O or ROM included in the management device 200 by a processing unit such as a CPU included in the management device 200.

The communication unit 201 communicates with the controller 30 of one or more shovels 100 via, for example, a network and the communication device T1 of the shovel 100. More specifically, the communication unit 201 receives, for example, the calibration result of the physical quantity detection device S transmitted via the communication device T1 of the shovel 100 as a working machine WM. In addition, the communication unit 201 transmits, for example, a notification urging the calibration of the physical quantity detection device S to the communication device of the shovel 100.

The calibration management unit 202 sends, for example, a notification to the communication device T1 of the shovel 100 as the working machine WM to urge the calibration of the physical quantity detection device S via the communication unit 201. The storage unit 203 stores, for example, the calibration result of the physical quantity detection device S received from the shovel 100 via the communication unit 201 in the storage unit included in the management device 200.

Figure 4:
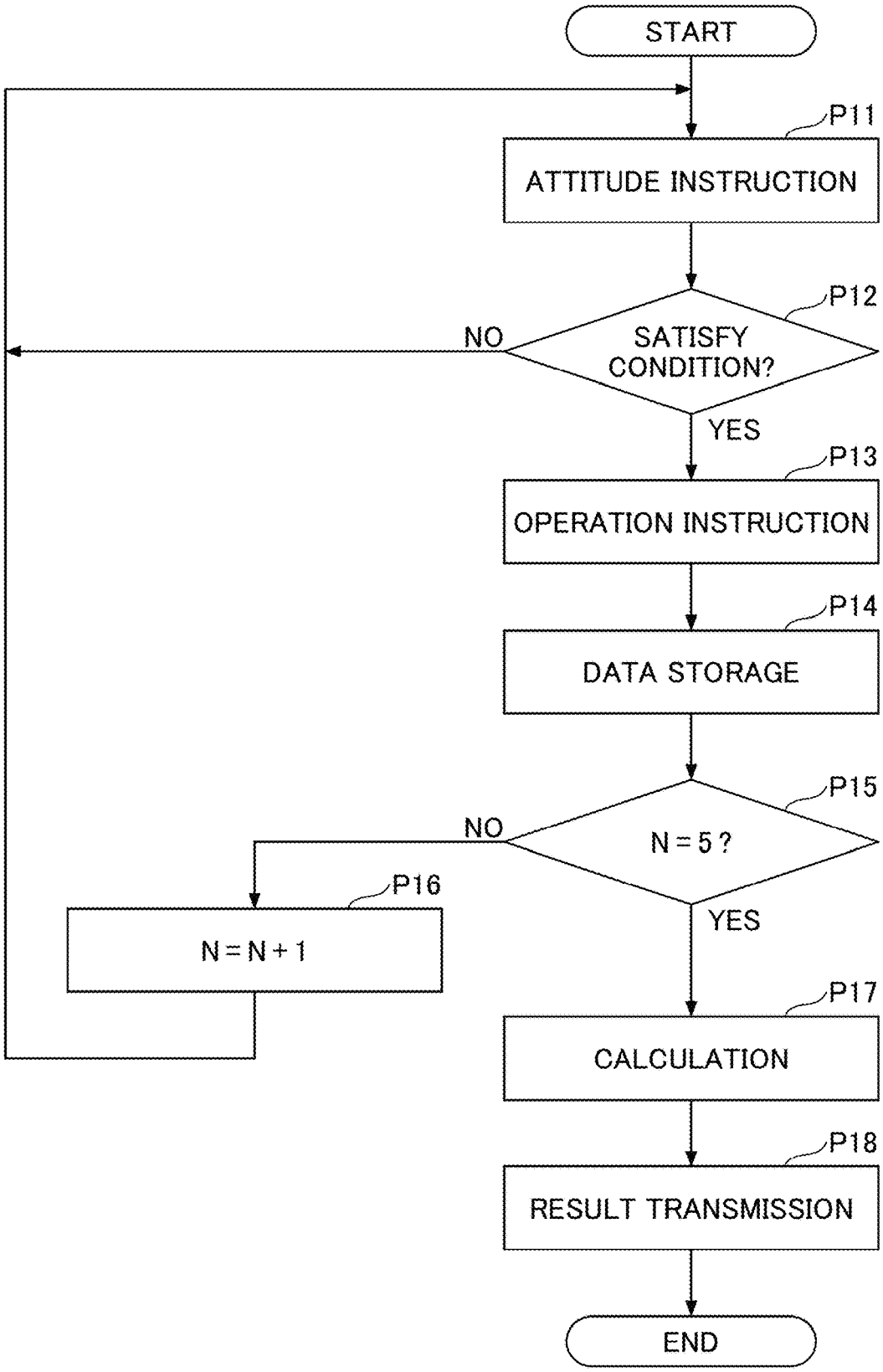
FIG. 4 is a flow diagram illustrating an example of calibration of a physical quantity detection device by the controller of FIG. 3.
Figure 5:
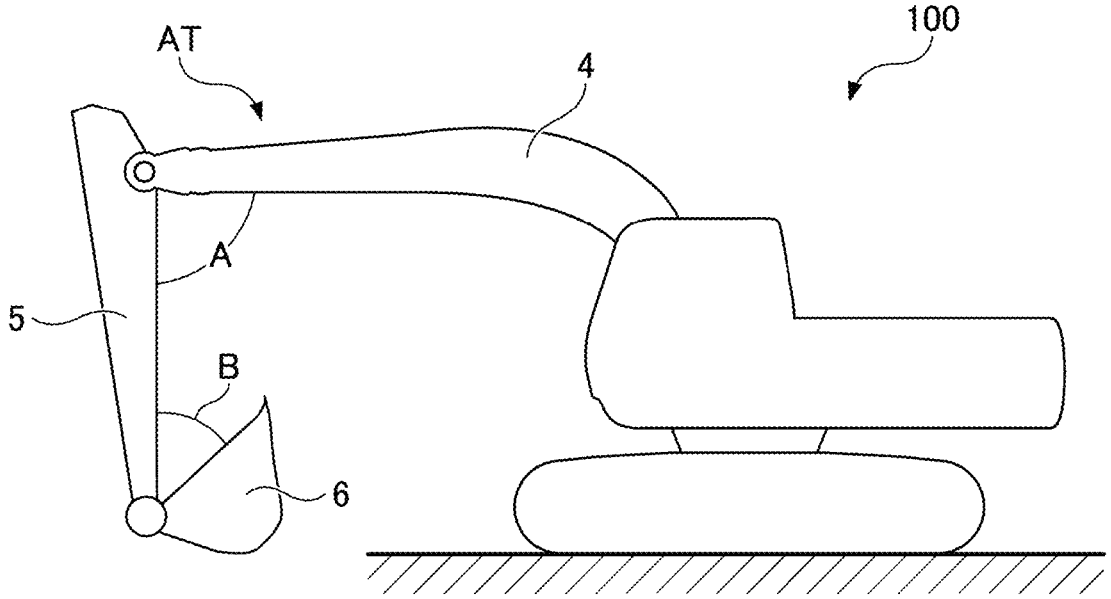
FIG. 5 is a schematic side view describing an attitude during calibration of the working machine of FIG. 1.

FIG. 4 is a flow diagram showing an example of the payload calibration executed by the controller 30 shown in FIG. 3. FIG. 5 is a schematic side view showing an example of the attitude taken by the shovel 100 when the controller 30 executes the payload calibration.

Before the controller 30 executes the payload calibration, for example, the operator inputs the ID (identifier) of the end attachment and the shape parameter of the end attachment, which is a parameter used to calculate the calculated center of gravity position. The shape parameter of the end attachment includes, for example, the width of the end attachment, the distance between predetermined parts of the end attachment, and the weight of the end attachment. The ID of the end attachment may be arbitrarily determined by the operator, or may be a predetermined serial number or character string.

When the controller 30 starts the process flow of the payload calibration shown in FIG. 4 during the calibration of the weight detection device included in the physical quantity detection device S, for example, the controller first executes the attitude instruction process P11.

In this process P11, the calibration unit 302 causes the display device 40 to display an image showing a predetermined attitude of the work attachment AT, for example, as shown in FIG. 5. More specifically, the calibration unit 302 causes the display device 40 to display an image instructing the angle A of the arm 5 with respect to the boom 4 and the angle B of the bucket 6 with respect to the arm 5, for example, to match the predetermined angle.

Here, the operator of the shovel 100 operates the operating device 26 while referring to the display device 40, so that the attitude of the work attachment AT with no load is matched with the attitude of the work attachment AT displayed on the display device 40.

Next, the calibration unit 302 executes a process P12 for determining whether the attitude of the work attachment AT satisfies the attitude condition indicated in the previous process P11 based on the detection result of the attitude detection device including, for example, the arm angle sensor S2 and the bucket angle sensor S3. When the calibration unit 302 determines in the process P12 that the attitude of the work attachment AT does not satisfy the attitude condition indicated in the previous process P11 (NO), the process P11 and the process P12 are repeated.

Conversely, in this process P12, when the calibration unit 302 determines that the attitude of the work attachment AT satisfies attitude condition indicated in the previous process P11 (YES), it executes the operation instruction process P13.

In this process P13, the calibration unit 302 causes the display device 40 to display, for example, an image or a sentence indicating a predetermined operation of the work attachment AT. Specifically, the calibration unit 302 causes the display device 40 to display, for example, a sentence or an image indicating an operation to raise the boom 4 while maintaining the angles A and B of the arm 5 and bucket 6. In addition, the calibration unit 302 may output sound to the audio output device 43.

Here, the operator of the shovel 100 operates the operating device 26 to raise the boom 4 while the work attachment AT maintains the angles A and B of the arm 5 and bucket 6. As a result, the detection result of the weight detection device including the boom rod pressure sensor S7R and the boom bottom pressure sensor S7B is input to the controller 30.

Simultaneously with the operation by the operator, the controller 30 executes, for example, data storage process P14. In this process P14, the storage unit 304 stores the detection result of the weight detection device in the storage unit of the controller 30 or the storage device 47 connected to the controller 30.

Next, the calibration unit 302 executes a process P15 to determine, for example, whether the number of times N of executing the process P14 has reached a predetermined number of times (for example, five times). In this process P15, when the calibration unit 302 determines that the number of times N of executing the process P14 has not reached a predetermined number of times (NO), it executes a process P16 to add 1 to the number of times N stored in the storage unit.

Subsequently, the calibration unit 302 executes the processes P11 to P15 again. It should be noted that, for example, the calibration unit 302 instructs the operator, via the display device 40, to adopt an attitude in which the angle A of the arm 5 and the angle B of the bucket 6 shown in FIG. 5 are different for each process P11 from the first time to the fifth time.

When the process P14 is executed a predetermined number of times by changing the attitude of the work attachment AT, the calibration unit 302 determines that the number of times N of executing the process P14 has reached a predetermined number of times (YES) in the process P15, and executes a process P17 to calculate the calculated center of gravity.

The storage unit 304 stores, for example, the calculated center of gravity, the shape parameter of the end attachment, and the ID of the end attachment calculated by the calibration unit 302 in the storage unit of the controller 30 or in the storage device 47 connected to the controller 30. Since the calculated center of gravity and the shape parameter of the end attachment are stored for each ID of the end attachment in the storage unit or the storage device 47 of the controller 30, the calculated center of gravity and the like of a plurality of end attachments can be stored. Then, the controller 30 executes a process P18 for transmitting, for example, the calibration result of the physical quantity detection device S.

In this process P18, the communication unit 303 transmits, for example, the calibration result of the physical quantity detection device S, the shape parameter of the end attachment, and the ID of the end attachment stored in the storage unit of the controller 30 or in the storage device 47 connected to the controller 30 to the external management device 200 via the communication device T1. Furthermore, information concerning the shape of the boom 4 or the arm 5 may be transmitted.

Here, the calibration result of the physical quantity detection device S includes, for example, the calibration result of the weight detection device. More specifically, the calibration result of the weight detection device includes, for example, the calculated center of gravity position of the work attachment AT calculated based on the detection result of the pressure detection device when the boom 4 is raised with the work attachment AT without a load in a predetermined attitude. Thereafter, the controller 30 terminates the process flow of the payload calibration shown in FIG. 4.

Figure 6:
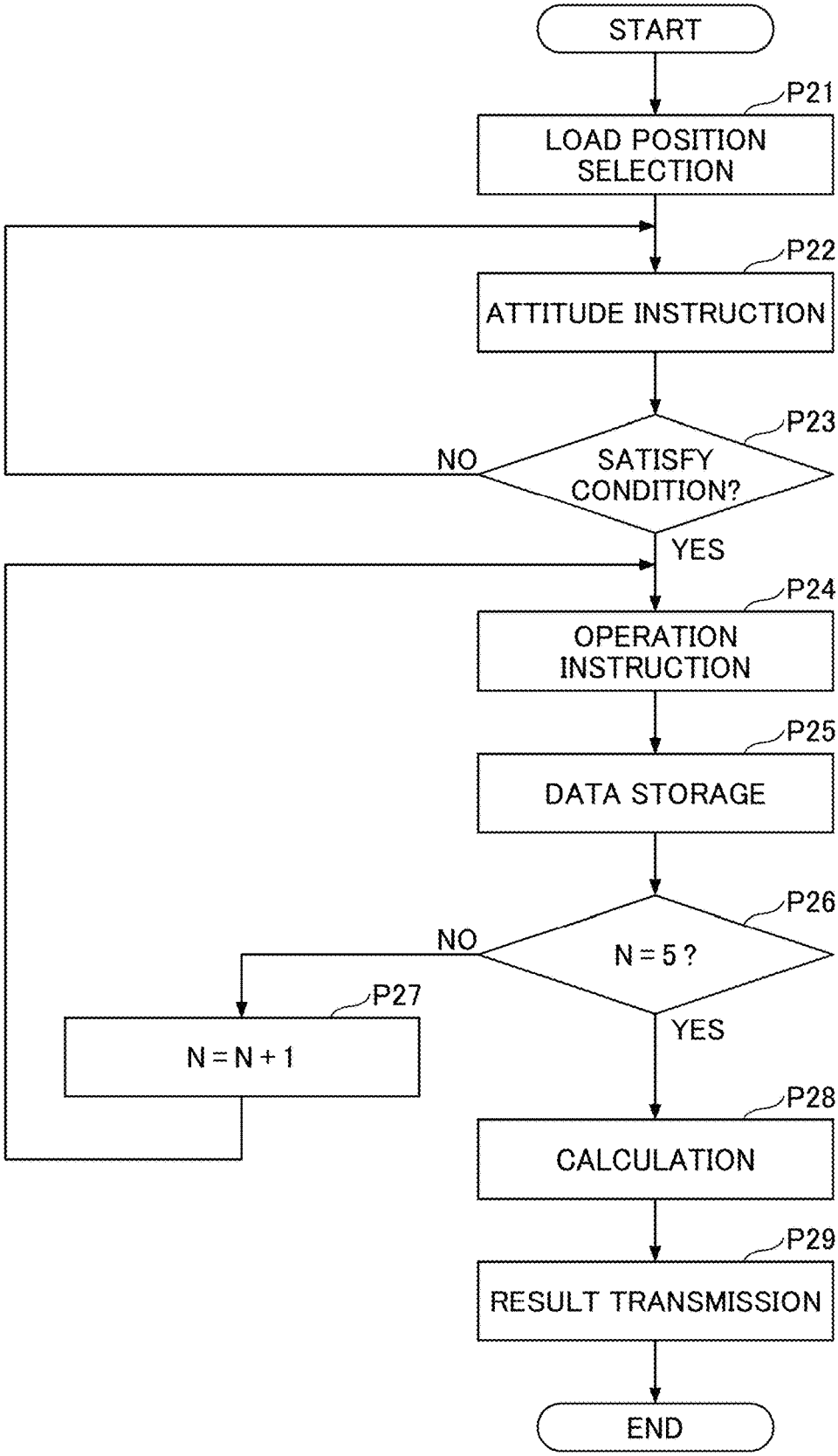
FIG. 6 is a flow diagram illustrating an example of calibration of the physical quantity detection device by the controller of FIG. 3.
Figure 7:
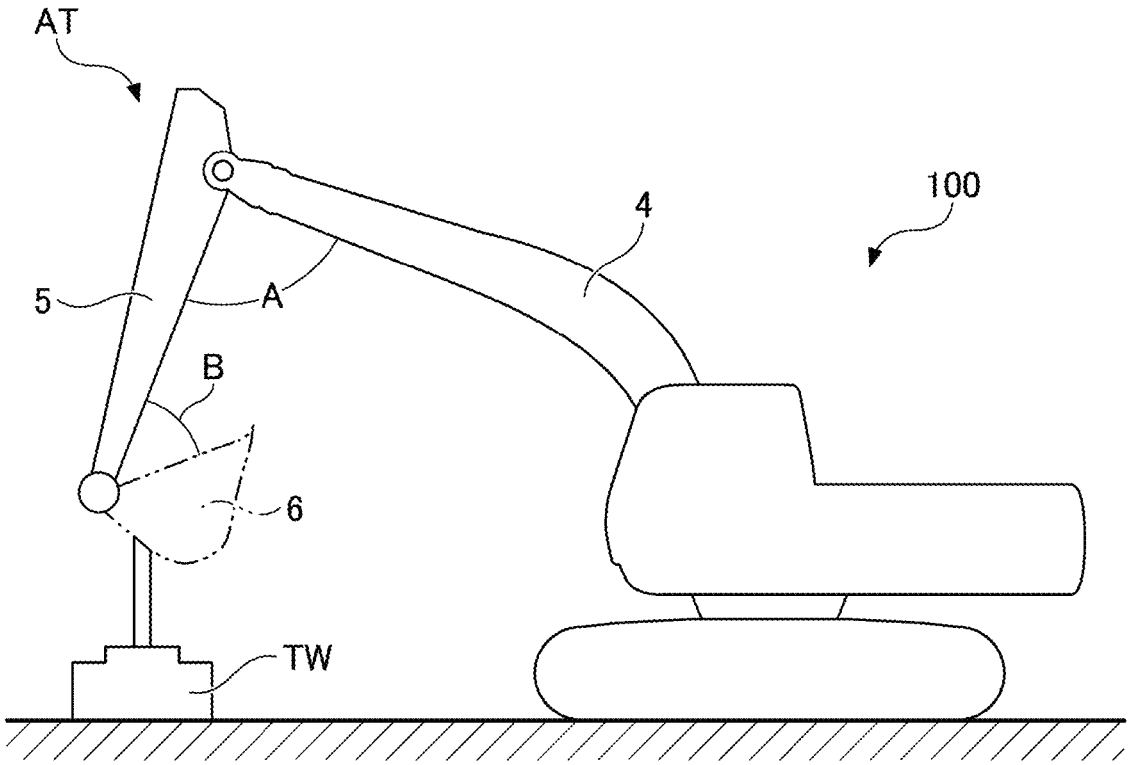
FIG. 7 is a schematic side view describing an attitude during calibration of the working machine of FIG. 1.

FIG. 6 is a flow diagram showing an example of the payload test executed by the calibration unit 302 of the controller 30 shown in FIG. 3. FIG. 7 is a schematic side view showing an example of the attitude taken by the shovel 100 when the calibration unit 302 executes the payload test.

When, for example, the calibration unit 302 starts the process flow of the payload test shown in FIG. 6 at the time of calibration of the weight detection device included in the physical quantity detection device S, the calibration unit first executes process P21 for selecting a position to load the test weight TW. The test weight TW is a calibration weight of the weight detection device, and its weight is known.

In the process P21, the calibration unit 302 displays, for example, a guidance image on the display device 40, and causes the operator of the shovel 100 to select a position to load the test weight TW. Here, the operator selects a position to load the test weight TW from among, for example, a crane hook provided at the bucket 6, the arm-top that is the tip of the arm 5 from which the bucket 6 is removed, and the inside of the bucket 6, and inputs the position to the input device 42. FIG. 7 shows an example of the case where the arm-top is selected in the process P21.

When the process P21 ends, the calibration unit 302 executes the attitude instruction process P22, the attitude determination process P23 of the work attachment AT, and the process P24 for instructing a predetermined operation, similar to the processes P11 to P13 of the payload calibration in FIG. 4.

Then, the calibration unit 302 executes, for example, the data storage process P25, the determination process P26 of the number of times N, and the addition process P27 of the number of times N, similar to the processes P14 to P16 of the payload calibration in FIG. 4. Thus, the processes P24 and P25 are repeated until the data storage process P25 of the predetermined number is executed.

Thereafter, when it is determined in the process P26 that the number of times of the process P24 has reached a predetermined number (YES), the calibration unit 302 executes the process P28 for calculating the detection error of the weight detection device. In this process P28, the calibration unit 302 calculates, for example, a detection error which is a difference between the weight detection result of the weight detection device stored in the storage device of the controller 30 or the like in each data storage process P25 and the known weight of the test weight TW.

Furthermore, the calibration unit 302 determines that the test weight TW calibration has passed the requirements if the detection error is within a predetermined range of the weight of the test weight TW, and determines that the test weight TW calibration has failed the requirements if the detection error is outside a predetermined range of the weight of the test weight TW. The storage unit 304 stores, for example, the detection error of the weight detection device, the pass/fail determination result, the position where the test weight TW is loaded, and the ID of the end attachment in the storage unit of the controller 30. The pass/fail determination may be determined by the operator or the business operator based on the detection result, and in this case, the pass/fail determination result may not be stored in the storage unit 304.

Subsequently, the communication unit 303 executes a process P28 for transmitting the detection result of the weight detection device, the detection error, the pass/fail determination result, the position where the test weight TW is loaded, and the ID of the end attachment stored in the storage unit of the controller 30 to the external management device 200 via the communication device T1 as the result of the payload test. If the pass/fail determination result is not stored in the storage unit 304, the pass/fail determination result may not be transmitted to the management device 200.

In this way, the calibration result of the weight detection device transmitted from the communication device T1 includes, for example, the detection result of the weight detection device when the boom 4 is raised with the work attachment AT with a predetermined load using the test weight TW in a predetermined attitude. Subsequently, the controller 30 terminates the process flow of the payload test shown in FIG. 6.

In addition, the controller 30 performs the zero adjustment of the weight detection device in order to offset the influence of an adhered material such as mud adhered to the end attachment such as the bucket 6. Since the process flow of zero adjustment has many parts in common with the process flow of payload calibration shown in FIG. 4, zero adjustment of the weight detection device by the controller 30 will be described with reference to FIGS. 4 and 5.

When the controller 30 starts zero adjustment of the weight detection device, it executes the attitude instruction process P11 similar to the payload calibration shown in FIGS. 4 and 5. In this process P11, the calibration unit 302 executes the process P11 for instructing the work attachment AT to take a predetermined attitude by emptying the bucket 6 of the work attachment AT via the display device 40, for example.

Then, the controller 30 executes the processes P12 to P17 similar to the payload calibration. The zero adjustment differs from the payload calibration in that the same attitude is instructed every time in the process P13, and in the process P17, the calculation of the zero adjustment of the weight detection device to cancel the weight of mud or the like adhering to the bucket 6 or the like based on the detection result of the weight detection device is performed.

Then, the communication unit 303 transmits the zero adjustment result stored in the storage device or the like of the controller 30 to the external management device 200 via the communication device T1 as the calibration result of the weight detection device. In this way, the calibration result of the weight detection device transmitted from the communication device T1 with the zero adjustment includes, for example, the zero adjustment result based on the detection result of the weight detection device when the boom is raised with the work attachment AT without a load in a predetermined attitude. Thereafter, the controller 30 terminates the process flow of the zero adjustment of the weight detection device.

The controller 30 may, for example, notify the operator of information urging the execution of the zero adjustment via a notification device such as a display device 40 or an audio output device 43 after a predetermined duration has elapsed from the execution of the zero adjustment. Specifically, the shovel 100 as the working machine WM has, for example, a display device 40 and an audio output device 43 as notification devices for notifying the operator of the shovel 100 of information. In addition, it may be possible to switch the presence or absence of notification of information urging the execution of the zero adjustment.

The calibration unit 302 of the controller 30 refers to, for example, the date and time when the zero adjustment was executed and the result of the zero adjustment was stored in the storage device or the like of the controller 30. The calibration unit 302 determines, for example, whether or not the result of the new zero adjustment was stored in the storage device or the like of the controller 30 before a predetermined duration has elapsed from the date and time when the latest zero adjustment was executed. Then, when the result of the new zero adjustment is not stored when the predetermined duration has elapsed, the calibration unit 302 causes the display device 40 and the audio output device 43 to output images and sounds to notify the information urging the execution of the zero adjustment.

Conversely, suppose that a new zero adjustment is performed before a predetermined duration has elapsed since the previous zero adjustment, and the result is stored in the storage device or the like of the controller 30. In this case, the calibration unit 302 notifies the operator of information urging the implementation of the zero adjustment, for example, when a predetermined duration has elapsed since the date and time when the new result was stored. That is, if a new zero adjustment is performed before a predetermined duration has elapsed since the previous zero adjustment, the calibration unit 302 does not issue a notification urging the implementation of the zero adjustment.

If the shovel 100 as the working machine WM is provided with the display device 40 and the audio output device 43 as notification devices for notifying the operator of information, the controller 30 may issue a notification urging the calibration of the physical quantity detection device S, for example, as follows. That is, when the controller 30 receives a notification urging the calibration of the physical quantity detection device S from the management device 200 via the communication device T1, for example, it may issue a notification urging the calibration of the physical quantity detection device S via the display device 40 and the audio output device 43.

Figure 8:
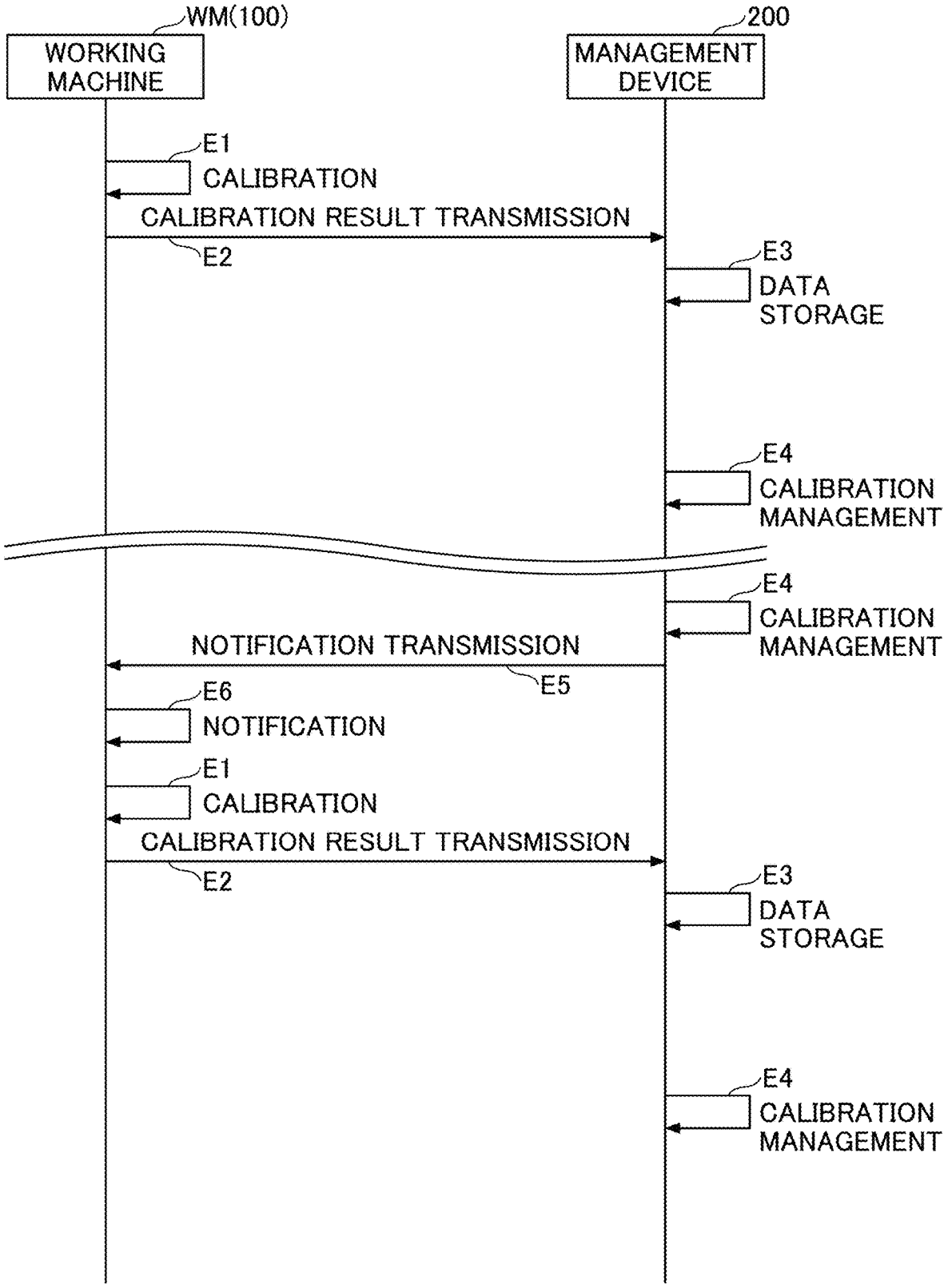
FIG. 8 is a time chart illustrating an operation example of the management system of the working machine of FIG. 1.

FIG. 8 is a time chart illustrating an example of a relation between the working machine WM and the management device 200 in the management system SYS of the working machine of the present embodiment.

First, in the working machine WM such as the shovel 100, for example, the calibration (E1) of the physical quantity detection device S is performed. The calibration of the physical quantity detection device S includes, for example, the calibration of the aforementioned weight detection device, and the process for calibrating the weight detection device may include payload calibration, payload test, and zero adjustment. The calibration of the physical quantity detection device S may also include the calibration of the physical quantity detection device S other than the weight detection device, such as the imaging device S6, the temperature sensor S10, the operating pressure sensor 29, and the discharge pressure sensor 28.

As a result of the calibration (E1) of the physical quantity detection device S in the working machine WM, the calibration result is transmitted from the working machine WM to the management device 200 via the communication device T1 (E2). The management device 200 receives the calibration result of the physical quantity detection device S transmitted via the communication device T1 of the working machine WM by the communication unit 201. Furthermore, the management device 200 stores the calibration result of the physical quantity detection device S received via the communication unit 201 in the storage device by the storage unit 203 (E3).

The calibration management unit 202 of the management device 200 performs calibration management (E4) to determine whether a predetermined duration has elapsed since the date and time when the calibration result of the physical quantity detection device S was stored by the storage unit 203, that is, the date and time when the most recent calibration of the physical quantity detection device S was performed. The calibration management unit 202 repeatedly performs calibration management (E4) at a predetermined cycle, for example.

Thereafter, the calibration management unit 202 of the management device 200 determines a lapse of the predetermined duration in the calibration management (E4) when the predetermined duration has elapsed without receiving a new calibration result of the physical quantity detection device S from the date and time when the latest calibration of the physical quantity detection device S was performed. Then, the calibration management unit 202 of the management device 200 transmits a notification urging the calibration of the physical quantity detection device S to the communication device T1 of the working machine WM via the communication unit 201 (E5).

When the controller 30 of the working machine WM receives a notification urging the calibration of the physical quantity detection device S from the management device 200 via the communication device T1, it notifies the operator of the working machine WM of information urging the calibration of the physical quantity detection device S via the display device 40 or the like as a notification device (E6).

As a result, in the working machine WM, the operator or the like performs the calibration of the physical quantity detection device S (E1), and the calibration result is transmitted from the working machine WM to the management device 200 via the communication device T1 (E2). The management device 200 receives the calibration result of the physical quantity detection device S transmitted via the communication device T1 of the working machine WM via the communication unit 201 and stores it in the storage device (E3). Subsequently, the calibration management unit 202 of the management device 200 repeatedly performs the calibration management (E4) at a predetermined cycle.

As described above, the working machine WM of the present embodiment includes the physical quantity detection device S, the controller 30 for calibrating the physical quantity detection device S, and the communication device T1 for transmitting the calibration result of the physical quantity detection device S to the external management device 200.

With such a configuration, a business operator who manufactures, repairs, maintains, etc. the working machine WM can refer to the calibration result of the physical quantity detection device S transmitted from the communication device T1 of the working machine WM used by the user to the external management device 200 of the working machine WM. Therefore, the business operator can easily know whether the user has properly calibrated the physical quantity detection device S of the working machine WM. Thus, for example, when a failure occurs in the physical quantity detection device S of the working machine WM of the user, the business operator can easily determine whether the failure is caused by a failure of the physical quantity detection device S or a failure to properly perform the calibration required for the physical quantity detection device S. Therefore, the business operator of the working machine WM can shorten the time required to respond to a failure occurring in the working machine WM of the user than before.

Further, the working machine WM of the present embodiment further includes a lower traveling body 1 capable of traveling, an upper swivel body 3 which is mounted on the lower traveling body 1 so as to be able to turn, a work attachment AT attached to the upper swivel body 3, and a drive device DS which drives the work attachment AT.

Thus, for example, when a failure occurs in the physical quantity detection device S of a working machine such as a shovel or a crane, the working machine WM of the present embodiment can easily determine whether the failure is caused by a failure of the physical quantity detection device S or a failure to properly perform the calibration required for the physical quantity detection device S. Therefore, the business operator of the working machine WM can shorten the time required to respond to a failure occurring in the working machine WM of the user than before.

Further, in the working machine WM of the present embodiment, the physical quantity detection device S includes a weight detection device for detecting the weight of a load loaded on the work attachment AT.

With such a configuration, in the working machine WM of the present embodiment, when a failure occurs in the weight detection device included in the physical quantity detection device S of the user's working machine WM, it is possible to easily determine whether the failure is caused by a failure of the working machine WM or due to improper calibration of the weight detection device.

Further, in the working machine WM of the present embodiment, the work attachment AT includes a boom 4 mounted to the upper swivel body 3 capable of lifting. The drive device DS includes a plurality of hydraulic cylinders. The weight detection device includes an attitude detection device for detecting the attitude of the work attachment AT and a pressure detection device for detecting the pressure of at least one of the hydraulic cylinders. The calibration result of the weight detection device includes the calculated center of gravity position of the work attachment AT calculated based on the detection result of the pressure detection device when a predetermined operation such as raising the boom 4 is performed with the work attachment AT without a load in a predetermined attitude.

With such a configuration, the business operator of the working machine WM can easily know whether or not the necessary payload calibration is properly performed in the weight detection device of the user's working machine WM. Therefore, the business operator can urge the user to properly perform the payload calibration or can confirm whether or not the payload calibration is properly performed when a failure occurs in the weight detection device.

In the working machine WM of the present embodiment, the calculated center of gravity position of the work attachment AT is calculated based on the detection result of the pressure detection device and the shape parameter of the work attachment AT input by the operator. In addition, the communication device T1 transmits the shape parameter of the work attachment AT to the management device 200 in addition to the above-described calibration result.

With this configuration, the calculated center of gravity position of the work attachment AT can be calculated more easily and accurately. Conversely, if there is an input error in the shape parameter input by the operator, the weight detection accuracy of the weight detection device may decrease. Therefore, by transmitting the shape parameter input by the operator from the communication device T1 of the working machine WM to the management device 200, the business operator of the working machine WM can confirm the weight detection accuracy decrease of the weight detection device caused by the input error.

In the working machine WM of the present embodiment, the calibration result of the weight detection device includes the detection result of the weight detection device when the boom 4 is raised with the work attachment AT with a predetermined load is in a predetermined attitude.

With such a configuration, the business operator of the working machine WM can easily know whether or not the necessary payload test is properly performed in the weight detection device of the user's working machine WM. Therefore, the business operator can urge the user to properly perform the payload test or confirm whether or not the payload test is properly performed when a failure of the weight detection device occurs.

In the working machine WM of the present embodiment, the calibration result of the weight detection device includes the result of zero adjustment based on the detection result of the weight detection device when the boom 4 is raised with the work attachment AT loaded without a load in a predetermined attitude.

With such a configuration, the business operator of the working machine WM can easily know whether or not the necessary zero adjustment is properly performed in the weight detection device of the user's working machine WM.

Therefore, the business operator can urge the user to properly perform the zero adjustment or confirm whether or not the zero adjustment is properly performed when a failure of the weight detection device occurs.

The working machine WM of the present embodiment is further provided with a notification device such as a display device 40 and an audio output device 43 for notifying the operator of the working machine WM of information. The controller 30 notifies the operator of the weight detection device via the notification device described above after the lapse of a predetermined duration from the execution of the zero adjustment of the weight detection device.

With this configuration, when the zero adjustment of the weight detection device is not performed for a predetermined duration due to the inaction of the user of the working machine WM, the operator of the user of the working machine WM can be urged to perform the zero adjustment through the notification device. As a result, it is possible to prevent defects such as a decrease in detection accuracy of the weight detection device.

The working machine WM of the present embodiment further includes notification devices such as a display device 40 and an audio output device 43 for notifying the operator of the working machine WM of information. When the controller 30 receives a notification urging the calibration of the physical quantity detection device S from the management device 200 via the communication device T1, the controller notifies the information urging the calibration of the physical quantity detection device S via the notification device.

With this configuration, when the calibration of the physical quantity detection device S has not been performed for a predetermined duration due to the inaction of the user of the working machine WM, it is possible to urge the operator of the user of the working machine WM to perform the calibration of the physical quantity detection device S via the notification device. As a result, it is possible to prevent problems such as a decrease in detection accuracy of the physical quantity detection device S.

The management system SYS of the working machine of the present embodiment includes the aforementioned working machine WM and a management device 200. The management device 200 includes a communication unit 201 which receives the calibration result of the physical quantity detection device S transmitted via the communication device T1 of the working machine WM and a storage unit 203 which stores the calibration result of the physical quantity detection device S received via the communication unit 201.

With such a configuration, a business operator who manufactures, repairs, and maintains the working machine WM can refer to the calibration result of the physical quantity detection device S transmitted from the communication device T1 of the working machine WM used by the user to the external management device 200 of the working machine WM. Therefore, the business operator can easily know whether the user has properly calibrated the physical quantity detection device S of the working machine WM. Thus, for example, when a failure occurs in the physical quantity detection device S of the working machine WM of the user, the business operator can easily determine whether the failure is caused by the failure of the physical quantity detection device S or the failure of the calibration required for the physical quantity detection device S. Therefore, the business operator of the working machine WM can shorten the time required to respond to the failure occurring in the working machine WM of the user than before. Moreover, by storing the calibration result of the physical quantity detection device S in the management device 200, the calibration result of the physical quantity detection device S can be referred to even when the controller 30 of the working machine WM fails.

In addition, in the management system SYS of the working machine of the present embodiment, the management device 200 further includes a calibration management unit 202 which transmits a notification urging calibration of the physical quantity detection device S to the communication device T1 of the working machine WM via the communication unit 201.

With this configuration, when calibration of the physical quantity detection device S is not performed for a predetermined duration due to the inaction of the user of the working machine WM, a notification urging calibration of the physical quantity detection device S can be transmitted from the communication unit 201 to the working machine WM. As a result, it is possible to urge the operator of the user of the working machine WM to perform calibration of the physical quantity detection device S, and it is possible to prevent defects such as detection accuracy degradation of the physical quantity detection device S.

Moreover, in the management system SYS of the working machine of the present embodiment, the management device 200 notifies the user of the calibration after a predetermined duration of time has elapsed after receiving the calibration result.

With this configuration, when calibration of the physical quantity detection device S is not performed for a predetermined duration due to the inaction of the user of the working machine WM, it is possible to urge the operator of the user of the working machine WM to perform calibration of the physical quantity detection device S. Therefore, it is possible to prevent defects such as detection accuracy degradation of the physical quantity detection device S.

The preferred embodiments of the present disclosure have been described in detail above. Further, the present invention is not limited to these embodiments, but various variations and modifications may be made without departing from the scope of the present disclosure.

For example, the calibration of the physical quantity detection device S includes, in addition to the calibration of the weight detection device, the calibration for correcting individual variations of the working machine WM, the calibration for correcting performance changes due to aging degradation, and the calibration for maintaining operation accuracy during automatic operation.

What is claimed is:

1. A working machine comprising:

a lower traveling body capable of traveling;

an upper swivel body rotatably mounted on the lower traveling body;

a work attachment attached to the upper swivel body;

an actuator configured to drive the work attachment;

a physical quantity detector;

circuitry configured to calibrate the physical quantity detector; and a transceiver configured to transmit a calibration result of the physical quantity detector to a management server that is located outside the working machine, wherein the physical quantity detector includes a weight detector configured to detect a weight of a load loaded on the work attachment, the work attachment includes a boom mounted to the upper swivel body capable of lifting, the actuator includes a plurality of hydraulic cylinders, the weight detector includes an attitude detector configured to detect an attitude of the work attachment, and a pressure detector configured to detect a pressure of hydraulic fluid in at least one of the plurality of hydraulic cylinders, the calibration result includes a calculated center of gravity position of the work attachment calculated based on a detection result of the pressure detector when a predetermined operation is performed with the work attachment without load in a predetermined attitude, the calculated center of gravity position is calculated based on the detection result of the pressure detector, and a shape parameter input by an operator; and the transceiver is configured to transmit the shape parameter to the management server in addition to the calibration result.

2. The working machine according to claim 1, wherein the calibration result includes a detection result of the weight detector when the boom is raised with the work attachment loaded with a predetermined load in the predetermined attitude.

3. The working machine according to claim 1, wherein the calibration result includes a result of a zero adjustment based on a detection result of the weight detector when the boom is raised with the work attachment without a predetermined load in the predetermined attitude.

4. The working machine according to claim 3, wherein the circuitry is further configured to notify the operator of the working machine of information urging implementation of the zero adjustment via a display, a speaker, or a buzzer after a predetermined duration of time has elapsed from the implementation of the zero adjustment.

5. The working machine according to claim 1, wherein the circuitry is further configured to notify the operator of the working machine of information urging the calibration via a display, a speaker, or a buzzer, when a notification urging the calibration is received from the management server via the transceiver.

6. A working machine management system comprising the working machine of claim 1, and the management server, wherein the management server includes a communication server configured to receive the calibration result transmitted via the transceiver of the working machine, and a storage configured to store the calibration result received via the communication server.

7. The working machine management system according to claim 6, wherein the management server further includes a calibration management transmitter configured to transmit a notification urging the calibration to the transceiver of the working machine via the communication server.

8. The working machine management system according to claim 7, wherein the management server is configured to notify urging the calibration after a predetermined duration of time after receiving the calibration result.

* * * * *